US009850652B2

(12) United States Patent
Marston

(10) Patent No.: US 9,850,652 B2
(45) Date of Patent: Dec. 26, 2017

(54) SEPTIC LINE CLEANING ASSISTANCE DEVICE

(71) Applicant: E & E Septic, LLC, Epping, NH (US)

(72) Inventor: Daniel Marston, Epping, NH (US)

(73) Assignee: E & E Septic LLC, Epping, NH (US)

( * ) Notice: Subject to any disclaimer, the term of this patent is extended or adjusted under 35 U.S.C. 154(b) by 64 days.

(21) Appl. No.: 14/796,303

(22) Filed: Jul. 10, 2015

(65) Prior Publication Data

US 2016/0032579 A1 Feb. 4, 2016

Related U.S. Application Data

(60) Provisional application No. 62/023,368, filed on Jul. 11, 2014.

(51) Int. Cl.
*E03F 9/00* (2006.01)
*B08B 9/035* (2006.01)

(52) U.S. Cl.
CPC ..... *E03F 9/002* (2013.01); *B08B 9/035* (2013.01)

(58) Field of Classification Search
CPC ..... E03F 9/002; B08B 9/035
USPC ..... 138/89, 90, 94, 94.5; 166/192; 137/247.47, 247.51
See application file for complete search history.

(56) References Cited

U.S. PATENT DOCUMENTS 5,076,095 A * 12/1991 Erhardt ..... G01M 3/2853 138/90
8,267,273 B2 * 9/2012 Volzke ..... B65D 39/0041 215/355
2010/0037977 A1 * 2/2010 Rahimzadeh ..... F16L 55/115 138/96 R

* cited by examiner

*Primary Examiner* — Craig Schneider
*Assistant Examiner* — David Deal

(57) ABSTRACT

A septic line cleaning assistance device that positions into alignment with a lower opening in a T-pipe to plug the lower opening in the T-pipe. The blocked lower opening enables a suction apparatus to suck waste from a pipe connected to a waste opening in the T-pipe through an upper opening in the T-pipe. A rod is configured to be inserted along the T-pipe and positioned into place along the T-pipe. The rod comprises a plug end holding the plug that is configured to frictionally engage the lower opening in the T-pipe to effectively seal the lower opening. A handle end having a grip enables the positioning of the plug over the lower opening, and pulling the plug into a mating position with the lower opening. An adjustable peripheral fastener is slidably positioned over the upper end of the T pipe to hold the device and plug in place.

3 Claims, 5 Drawing Sheets

SEPTIC LINE CLEANING ASSISTANCE DEVICE

CROSS-REFERENCE TO RELATED APPLICATIONS

This application claims priority from U.S. Provisional Patent Application No. 62/023,368 entitled "SEPTIC LINE CLEANING ASSISTANCE DEVICE", filed on Jul. 11, 2014 which is incorporated fully herein by reference.

FIELD OF THE INVENTION

The present invention relates to a device that enables regulated suction of a T-pipe from a waste source to an external upper opening in the T-pipe; and more particularly, relates to a septic line cleaning device that is lowered into alignment with a T-pipe for plugging a lower opening on the T-pipe to allow for suction of a fluid from a waste pipe or opening through an upper opening in the T-pipe.

BACKGROUND OF THE INVENTION

It is known that a septic tank is a key component of a septic system used to receive and process household waste effluent. The septic tank is a small-scale sewage treatment system common in areas with no connection to main sewage pipes provided by local governments or private corporations. The septic tank generally consists of a tank of between 1,000 and 2,000 gallons connected to an inlet wastewater pipe at one end, and a septic drain field at the other. In general, the inlet pipe connections is made through a T pipe baffle, which allows liquid to enter and exit without disturbing any crust on the surface. A "T" pipe baffle is connected to the building drain line in the middle portion of the "T" which the effluent drops downward when entering the "T" while the top portion is open and unused.

Recent septic tank designs provide for the inlet T-Baffle that effectively joins the building plumbing with the inlet to the septic tank. The septic line between a building and the septic tank is a continual source of plugging due to objects being flushed down the toilet or drains.

The prior art method of cleaning the septic line from the building to the tank involves running a metal coil, referred to as a "snake", down the septic line from the toilet in the house or from a clean out opening provided in the drain line as the line exits the home. This caused a mess and was very time consuming. Additionally, use of the snake typically involves having to clean the septic line from inside the house. Furthermore, the septic line to the septic tank often follows a tortuous path that makes the snake difficult to maneuver within the septic line.

Accordingly, what is needed is a device that plugs a portion of a "T" connection within in the septic tank to enable external cleaning of the septic line through direct suction from the tank and not the home or building by connecting a suction device to the top most opening of the "T" baffle.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

SUMMARY OF THE INVENTION

This invention is directed to a septic line cleaning assistive device that positions into alignment with one of three inlets on a T-pipe on a septic line, to block or plug the lower opening of the T-pipe while allowing access by a septic line cleaning hose or line to an upper opening in the T-pipe. The blocked lower opening enables a suction apparatus to suck waste through an upper opening in the T-pipe.

The device comprises a substantially linear rod configured to be easily inserted through a surface aperture, such as a septic tank clean-out, and positioned into place along the T-pipe. The rod includes a plug at one end configured to mate with the lower opening in the T-pipe. The plug end includes a plug that frictionally engages the lower opening to effectively seal the lower opening and enable the fluid to flow directly from the waste opening from the sewer line connected to the second of the three "T" openings and up through the upper opening in the T-pipe to which is connected a suction line from a device such as a septic-tank cleaning truck.

The rod further includes a handle end having a grip for enabling the positioning of the plug into the lower opening, and for pulling the plug into a mating position with the lower opening. An adjustable peripheral fastener is provided on the rod and is configured to slide up and down the rod and in use, slides down over the top or upper "T" opening to prevent the plug from falling out of the bottom of the "T". In this manner, a suction apparatus (such as a suction hose from a septic truck) can mate with the upper opening and create a vacuum from the upper opening through the horizontal line coming in from the home or business into the septic tank such that the T-pipe and the septic line leading to the waste source can be suctioned and cleaned/unplugged externally from the upper opening of the T-pipe in the septic tank.

In this manner, the septic tank content beneath the lower opening remains in place, as only the passage between the waste source and the upper opening of the T-pipe is suctioned cleaned. In essence, the present invention provides an efficient manner of cleaning a septic line between a waste source and a "T" pipe connection within a septic tank without having to access the inside of a building.

In a preferred embodiment, the handle end comprises a peripheral fastener arranged to extend in a substantially perpendicular arrangement from the rod. The peripheral fastener is preferably circular in shape and designed and configured to surround the T-pipe for securing the rod to the T-pipe and also helps to align the plug with the lower opening.

In operation, the septic line cleaning device is lowered such that the plug is in alignment with a lower opening of the T-pipe (the lower opening of the "T" is generally located below the liquid level in the tank), for plugging a lower opening of the T-pipe. In this manner external suction of waste is possible from an upper opening in the T-pipe to draw and remove waste from the waste pipe located between the building and the "T" connector or baffle in the tank and not from the tank itself.

In one aspect of the present invention, a pipe cleaning device for regulating flow of a fluid while cleaning a pipe comprises a rod including a plug end and a handle end. The plug end comprises a plug base arranged substantially perpendicular to the rod. The plug base is configured to join with a plug, wherein a smaller diameter end of the plug is disposed and oriented towards the handle end and parallel to the rod. The plug is configured to restrict/block flow of the fluid through a lower opening in a T-pipe.

The handle end comprises a grip configured to enable manipulation of the rod for positioning of the plug. The rod further comprises a peripheral fastener configured to align the plug end into the T-pipe and align the plug to the lower opening in the T-pipe, wherein the plugged lower opening enables the fluid to flow from a waste opening in the T-pipe to an upper opening in the T-pipe. The peripheral fastener is configured to slide up and down the length of the rod. In use, the peripheral fastener is lowered onto and around the top opening of the T-pipe and prevents the plug end from falling out of the bottom opening in the T-pipe. The device allows for suction cleaning of a septic line between an external surface aperture and a waste source without requiring internal entry of a building to access the waste source.

The rod is preferably a rigid metal or hard plastic or some similar material configured to pass through a surface aperture, such as a drain hole or septic tank clean out opening. The rod is sufficiently rigid to forcefully pull the plug into frictional engagement with the lower opening.

The plug typically has a conical or tapered shape sized and dimensioned to frictionally mate with the lower opening of the T-pipe. The plug is preferably made of a resilient material such as rubber or silicone. The plug forms a seal that prevents the flow of air and waste fluid from beneath the lower opening of the T-pipe, such that a suction is generated only between the top opening of the T-pipe and the middle horizontal portion of the T pipe.

The invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention.

BRIEF DESCRIPTION OF THE DRAWINGS

These and other features and advantages of the present invention will be better understood by reading the following detailed description, taken together with the drawings wherein:

FIGS. 1A and 1B are various views of an exemplary septic line cleaning assistance device according to the invention, wherein FIG. 1A is a detailed perspective view, and FIG. 1B is a rear view;

FIG. 4A is a top view and FIG. 4B is a bottom view.

DETAILED DESCRIPTION OF THE INVENTION

Figure 1A:
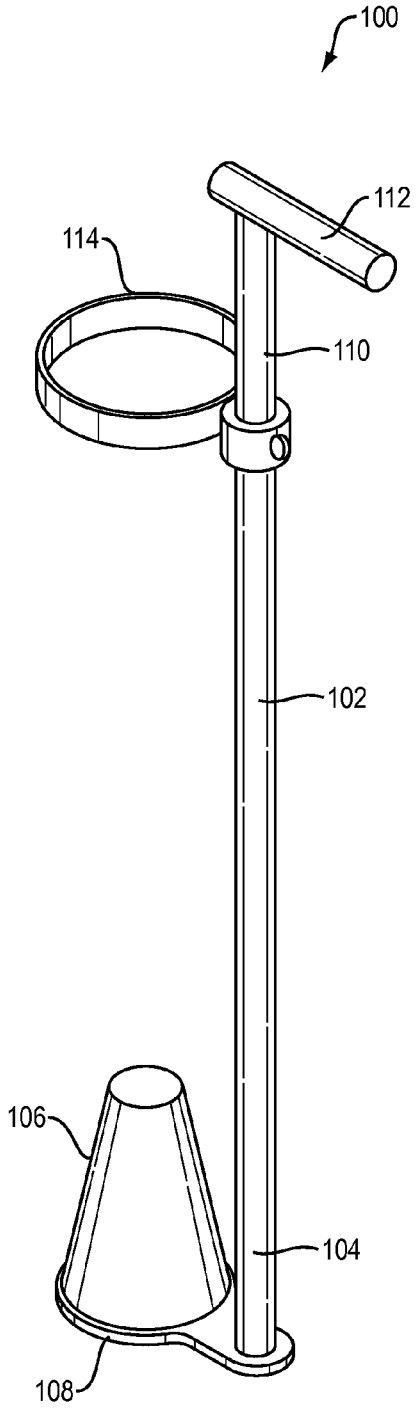

The present invention is described in connection with FIGS. 1-5, and provides a septic line cleaning assistance device 100 that is configured to be positioned into alignment with a T-pipe 200 on a septic line 216 to block or seal a lower opening 204 in the T-pipe 200. The blocked lower opening 204 then enables a suction apparatus (not shown but including for example a septic tank cleanout vacuum line coupled to a septic tank cleaning truck) to suck waste from a waste opening 206 in the T-pipe 200 through an upper opening 202 in the T-pipe 200. The waste opening 206 receives waste from a waste source such as a home or business or other structure. The upper opening 202 mates with a suction device (such as a suction hose from a septic tank cleaning truck) to enable the effluent 208 to flow directly from the waste opening 206 to the upper opening 202 and into the suction cleaning hose 121.

A septic tank inlet T baffle plug 106 allows the septic line 216 between an occupied structure and an external opening to be suctioned clean without disturbing the septic tank, and without requiring internal entry of the building to access the beginning of the septic line 216. Rather, the waste is sucked out through an external aperture (the "T" pipe) in a septic tank 201.

Figure 1B:
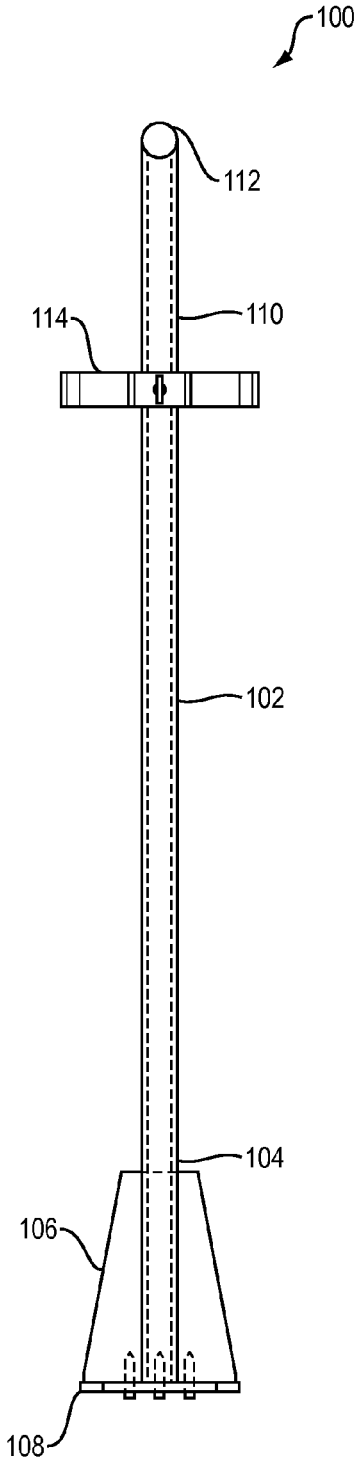

As referenced in FIGS. 1A and 1B, the device 100 according to the invention comprises a substantially linear rod 102 configured to be easily inserted through a surface aperture, such as a drain clean-out or a septic tank opening 203. The rod 102 is sufficiently rigid (of metal, plastic or some other similar rigid material) so as to allow the user to pass the device 100 through the surface aperture 203, yet flexible enough to maneuver through tight or tortuous cavities. Suitable materials for the rod 102 can include, without limitation, iron, aluminum, metal alloy, rigid polymers, polyurethane, fiberglass, and wood. The rod 102 is sufficiently rigid to allow the user to forcefully pull the plug 106 into frictional engagement with the lower opening 204 of the "T". The rod 102 positions into alignment with the T-pipe 200.

Figure 2:
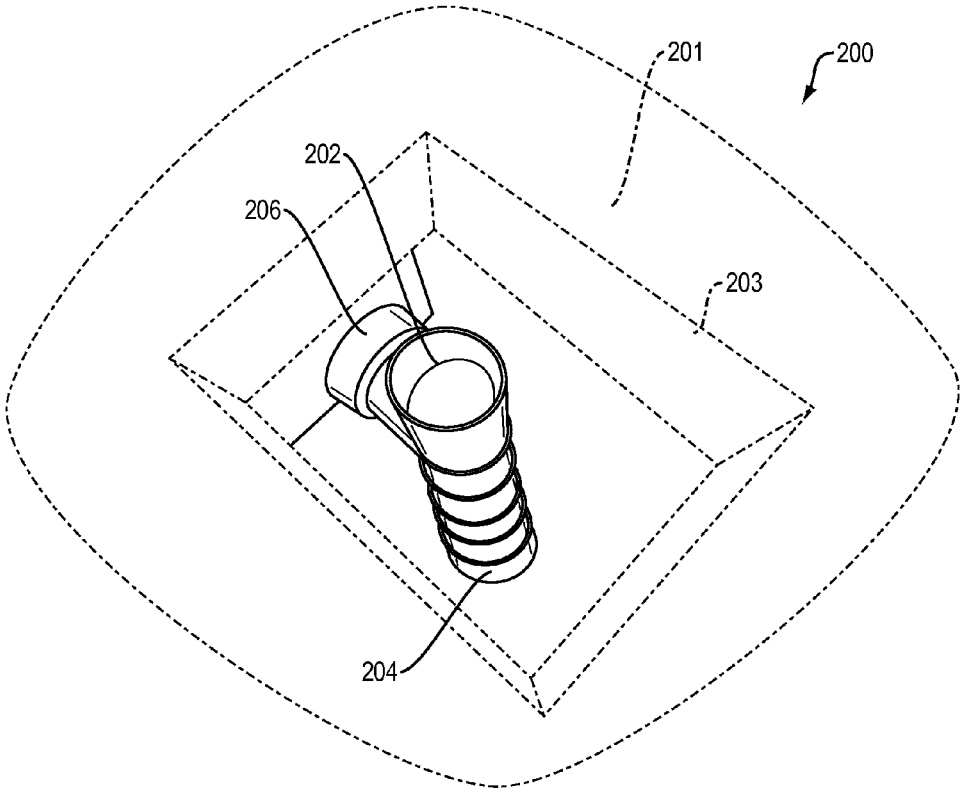
FIG. 2 is a upper angle perspective view of an exemplary T-pipe joined with a waste source as viewed through a clean out opening in a septic tank.

Turning now to FIG. 2, the T-pipe 200 can include, without limitation, an inlet T baffle formed as a T junction. The T-pipe 200 effectively forms a three-way junction between the waste source input 206, the septic tank via a lower end aperture 204, and an external or upper surface aperture 202. The waste opening 206 mates with the waste source, which can include a toilet and septic line 216 leading thereto. The lower opening 204 opens into a septic tank or sewer system 201. The upper opening 202 opens up into the septic tank (above the waste level) or external ambient air and also allows for receiving the suction apparatus as will be described below.

Figure 3:
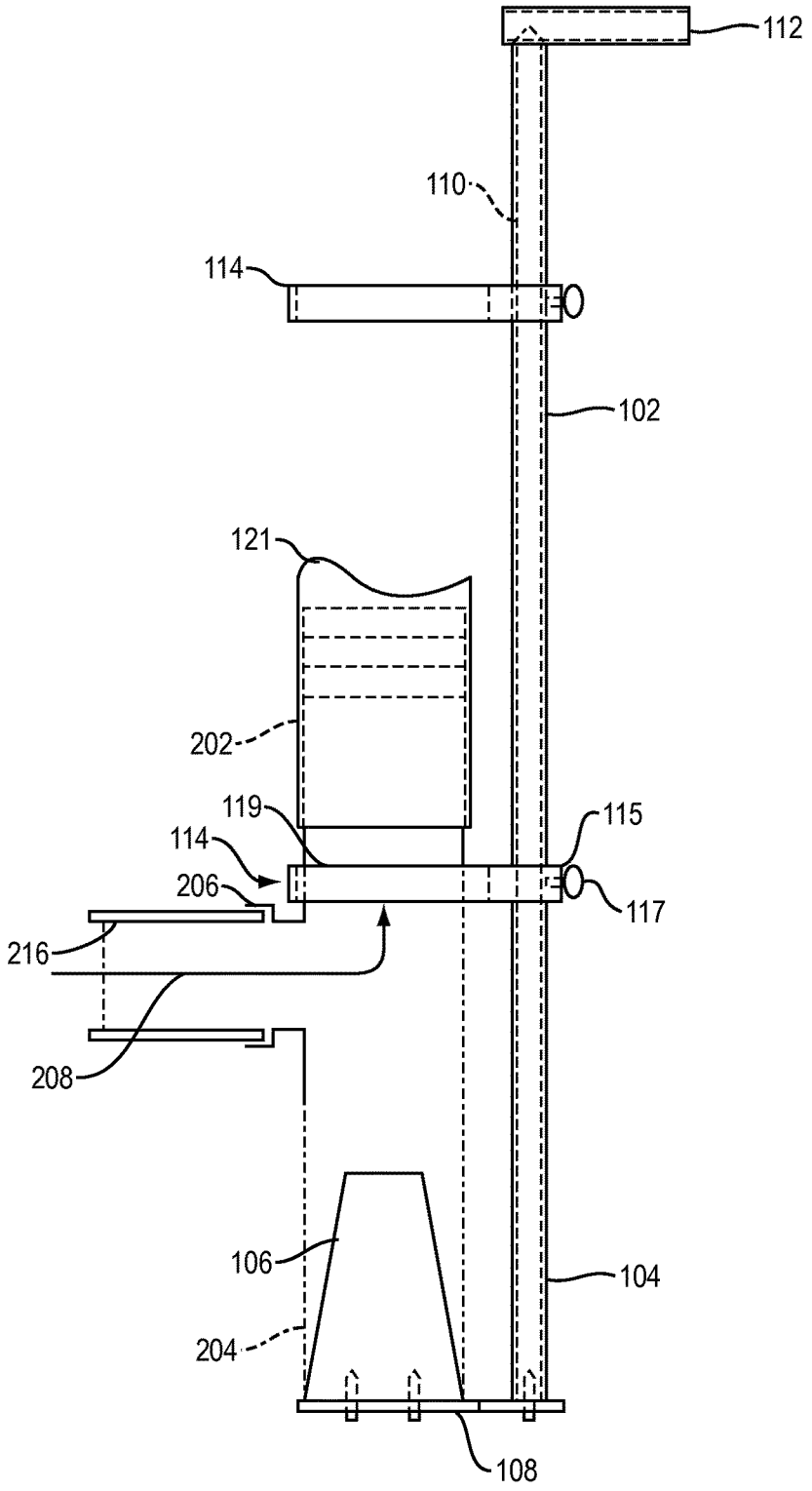
FIG. 3 is a sectioned side schematic view of an exemplary septic line cleaning assistance device showing the rod aligning with the T-pipe and an exemplary plug frictionally engaging the lower opening in the T-pipe.

As referenced in FIG. 3, the rod 102 comprises a plug end 104 configured to mate with the lower opening 204 in the T-pipe 200. The plug end 104 is disposed at a distal point that engages the lower opening 204. The plug end 104 comprises a plug base 108 arranged substantially perpendicular to the rod 102. The plug base 108 joins with and supports a plug 106.

Figure 4A:
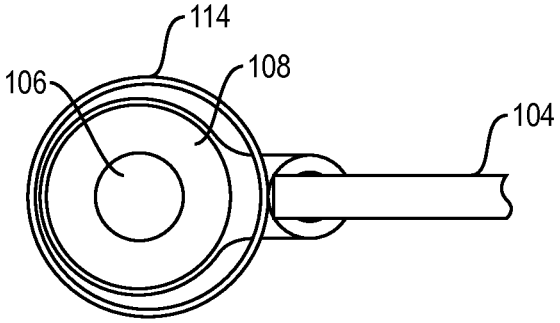
FIGS. 4A and 4B are views of an exemplary plug end of the rod, where
Figure 4B:
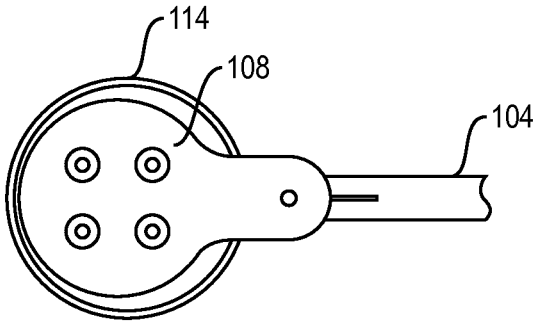
Figure 5:
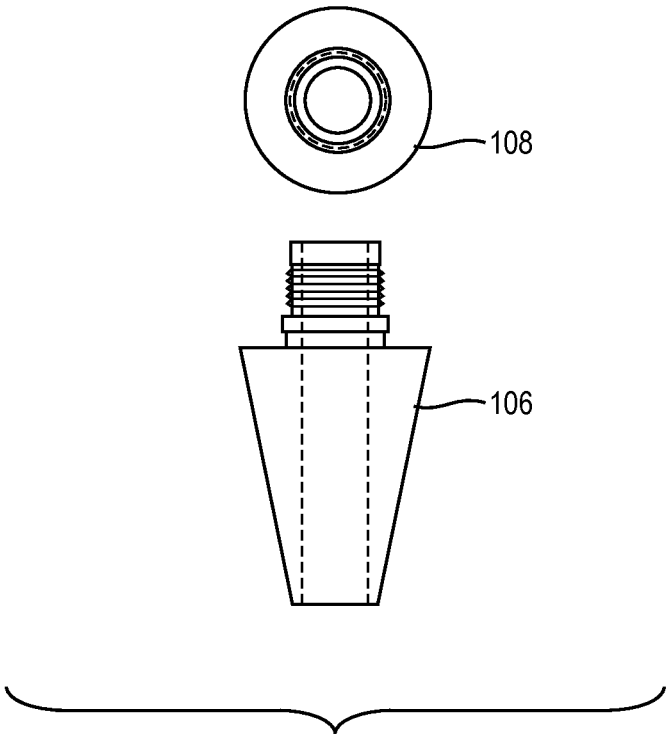
FIG. 5 is a view of an exemplary plug base and an exemplary threaded plug.

FIG. 4A illustrates a top view of the plug end 104, whereby the plug 106 is oriented in a substantially vertical direction for proper sealing of the lower opening 204. FIG. 4B shows the base plug 106 bolted into the plug 106 to form a stable plug 106 for sealing the lower opening 204. As referenced in FIG. 5, another embodiment provides the plug 106 threadably engaging the plug base 108 to form a secure attachment thereto. However, the plug base 108 and the plug 106 can also be attached together through and by other means, including, without limitation, screws, magnets, frictional engagement, adhesives, and locking pins.

The plug 106 is disposed to orient away from the plug end 104, and towards an upper opening 202 in the T-pipe 200. The plug 106 is configured to restrict flow of an effluent 208 through a lower opening 204 of a T-pipe 200. This flow restriction enables the effluent 208 to flow from the waste opening 206 into the upper opening 202 of the T-pipe 200. The fluid can include, without limitation, water, sludge, sewage and the like.

FIG. 3 shows the plug 106 frictionally engaging the lower opening 204 of the T-pipe 200 to effectively seal the lower opening 204. In a preferred embodiment, the plug 106 includes a rubber conical member sized and dimensioned to frictionally mate with the lower opening 204 of the T baffle.

The rod 102 further includes a handle end 110 for manipulating the rod 102 and the plug 106. The handle end 110 comprises a grip 112 for enabling the positioning of the plug 106 into the lower opening 204, and for pulling the plug 106 into a mating position with the lower opening 204. The grip 112 can include any type of grip 112 that a hand or machine can grasp.

In a preferred embodiment, the device 100 of the invention further includes a peripheral fastener 114 arranged to extend in a substantially perpendicular arrangement from the rod 102. The peripheral fastener 114 is configured to slide up and down along the longitudinal axis of the rod 102 to engage the T-pipe 200. The peripheral fastener 114 includes a rod interconnection portion 115 that allows the peripheral fastener 114 to slide up and down the rod 102 and be held in place by securing an adjustable knob 117. The peripheral fastener 114 also includes a T pipe interconnection portion 119 in the form of a ring that may be size adjustable to encompass various diameters of T-pipes 200. The peripheral fastener 114 is configured for being lowered into position and surrounding the upper most portion 202 of the T-pipe 200, for securing the rod 102 and the plug end 106 to the T-pipe 200 and also helping to align the plug 106 with the lower opening 204.

In operation, the septic line 216 septic line 216 cleaning device 100 is lowered into alignment with a T-pipe 200 for restricting the flow of effluent 208 through the lower opening 204 of the T-pipe 200. In this manner external suction of waste is possible from the upper opening 202 in the T-pipe 200 to remove waste from the waste opening 206 in the T-pipe 200 through the septic line 216. In one possible embodiment of use, a user holds the device 100 by the grip 112 and lowers the rod 102 through the surface aperture of a septic tank or cover hole 203. The user then aligns the plug 106 with the lower opening 204 of the T-pipe 200 and applies an upward force to frictionally engage the tapered plug 106 with the lower opening 204, as shown in FIG. 3. The tapered shape of the plug 106 allows the plug 106 to be sized so as to fit into several differently sized T-pipes 200.

The user then slides down the peripheral fastener 114 along the rod 102 around an upper section of the T-pipe 200 to help stabilize the device 100 in place. A suction hose 121 from a suction apparatus, such as a sewer suction truck (not shown), can then be attached to the upper opening 202, and the septic line 216 between a house or building and the waste opening 206 in the T pipe is suctioned to remove blockages from waste. The suction apparatus joins with the upper opening 202 to pull waste through the T-pipe 200 and the septic line 216 leading to the waste source. In this manner, the suction apparatus can create a vacuum from the upper opening 202 such that waste in the T-pipe 200 and the septic line 216 leading to the waste source can be suctioned externally without creating any suction of waste material in the tank from the bottom of the T-pipe.

Those skilled in the art will recognize that the cleaning of the septic line 216 and T-pipe 200 occurs while the contents in a septic tank beneath the lower opening 204 remain undisturbed, as only the passage between the waste opening 206 and the upper opening 202 in the T-pipe 200 are suctioned cleaned. Once the cleaning is finished, the peripheral fastener 114 is loosened from the T-pipe 200 and raised towards the upper opening 202 for disengagement with the T-pipe 200. The plug 106 is pressed out of the lower opening 204 by a downward pressure or motion with or without a twisting motion, and a cover on the septic tank is replaced. In essence, the present invention provides an efficient manner of cleaning a septic line 216 between a waste source and a surface aperture without having to access the inside of an occupied structure.

The present invention is not intended to be limited to an apparatus or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

What is claimed is:

1. A septic line cleaning assistance device, configured for being positioned into alignment with a T-pipe connector coupled to a septic line, said T-pipe connector having an inlet, fluidly coupled to said septic line and disposed perpendicular to a downward facing outlet and an upward facing waste opening, said septic line cleaning assistance device configured to seal said downward facing outlet in the T-pipe, said septic line cleaning assistance device comprising:

a rod having a longitudinal axis, and a plug end disposed on a first end of said rod and a handle end disposed on a second end of said rod opposite from said first end of said rod, said plug end comprising a plug end base arranged substantially perpendicular to the longitudinal axis of said rod, the plug end base configured to fixedly interconnect with a flat base region of a plug, said plug comprising a tapered cone having said flat base region and a top region, said tapered cone flat base region coupled to said plug end base on said first end of said rod, said tapered cone having a longitudinal axis oriented perpendicular to said flat base region of said rod, said longitudinal axis of said tapered cone offset from and parallel to said longitudinal axis of said rod, said top region of said tapered cone disposed and oriented toward the handle end of said rod, said tapered cone configured for frictionally engaging with said downward facing outlet in said T-pipe, for preventing the flow of fluid through said downward facing outlet in said T-pipe, wherein the tapered cone is configured for frictionally engaging with said downward facing outlet in said T-pipe and configured to plug the downward facing outlet in the T-pipe enabling fluid to flow and be suctioned from said septic line, fluidly coupled to said inlet of the T-pipe through said upward facing waste opening in the T-pipe by means of a septic line suction device; and a peripheral fastener, said peripheral fastener including a rod interconnection portion and a T-pipe interconnection portion, said peripheral fastener slidably disposed on said rod and configured to be slid along said longitudinal axis of said rod into a first position over and generally around said upper facing waste opening in said T-pipe, for maintaining said plug in frictional engagement with said downward facing outlet in said T-pipe, and configured to be slid along said longitudinal axis of said rod into a second position disengaged from said T-pipe, allowing said septic line cleaning assistance device to be removed from interconnection with said T-pipe.

2. The septic line cleaning assistance device of claim 1, wherein said handle end comprises a grip portion configured to enable manipulation of the rod for positioning of the plug.

3. The septic line cleaning assistance device of claim 1, wherein said tapered cone shaped plug is made of a resilient material selected from the group of materials consisting of rubber and silicone.

* * * * *